United States Patent [19]

Clement

[11] Patent Number: 5,022,122

[45] Date of Patent: Jun. 11, 1991

[54] COMBING MACHINE

[75] Inventor: Heinz Clement, Winterthur, Switzerland

[73] Assignee: Rieter Machine Works, Ltd., Winterthur, Switzerland

[21] Appl. No.: 455,293

[22] Filed: Dec. 22, 1989

[30] Foreign Application Priority Data

Dec. 23, 1988 [CH] Switzerland ..... 04784/88

[51] Int. Cl.[5] ..... D01G 19/16

[52] U.S. Cl. ..... 19/225; 19/229; 19/231; 19/232; 19/115 A

[58] Field of Search ..... 19/115 A, 223, 225, 19/229, 231, 232

[56] References Cited

U.S. PATENT DOCUMENTS

| | | | |
|---|---|---|---|
| 1,156,225 | 10/1915 | Helmbold et al. | 19/231 |
| 3,103,041 | 9/1963 | Nydam | 19/225 |
| 3,125,783 | 3/1964 | Gauvain | 19/225 |
| 3,290,731 | 12/1966 | Kajori | 19/231 |
| 3,479,699 | 11/1969 | Kaenel et al. | 19/223 |
| 3,584,346 | 6/1971 | Eichenberger | 19/232 |
| 3,604,063 | 9/1971 | Von Kaenel et al. | 19/231 |
| 3,960,024 | 6/1976 | Mori et al. | 74/52 |
| 4,028,776 | 6/1977 | Murao | 19/232 |
| 4,166,399 | 9/1979 | Kiper et al. | 19/229 |
| 4,549,412 | 10/1985 | Stoll et al. | 66/149 R |

FOREIGN PATENT DOCUMENTS

| | | | |
|---|---|---|---|
| 3028918 | 2/1988 | Japan | 19/231 |

*Primary Examiner*—Werner H. Schroeder
*Assistant Examiner*—Michael A. Neas
*Attorney, Agent, or Firm*—Kenyon & Kenyon

[57] ABSTRACT

The combing machine has at least one comber head which contains a continuously rotatable comb cylinder, a reciprocating nipper jaw unit and at least one detaching roller. The detaching roller is rotated during every revolution of the comb cylinder at first through a small angle in a backwards direction and then through a large angle in a forward direction. The rotations of the detaching rollers are produced by an electric motor which receives appropriate drive pulses fed from an electronic control unit.

18 Claims, 2 Drawing Sheets

COMBING MACHINE

This invention relates to a combing machine. More particularly, this invention relates to a combing head for a combing machine.

As is known, various types of combing heads have been provided in textile machines for the combing of fiber. For example, combing machines are known which are provided with a plurality of combing heads, each of which has a reciprocating nipper unit, a comb cylinder which is continuously rotated by a driving motor and at least one pair of detaching rollers for removing a fiber tuft from the nipper jaw unit. In this respect, the detaching rollers must first be rotated backwards in every comber nip. That is, as a rule, every rotation of the comb cylinder must be preceded by a backwards rotation of the detaching roller through a determined angle. Subsequently, the detaching roller is be rotated forwards through another larger angle. In the machines which are known, this movement of the detaching roller is derived from the rotation of the comb cylinder over a mechanical gear transmission. However, a gear transmission of this type is very complicated and therefore expensive. In addition, relatively large masses must be reciprocated, which has a negative influence at higher comber nip figures (rotational speeds of the comb cylinder) of up to 300 to 400 rpm.

Accordingly, it is an object of the invention to produce a drive for a detaching roller of a combing machine which does not require an expensive gear transmission or large masses to be reciprocated.

It is another object of the invention to simplify the construction of a combing head for a combing machine.

It is another object of the invention to reduce the amount of mass required to be reciprocated during operation of a combing head of a combing machine.

Briefly, the invention provides a combing head for a combing machine which is comprised of a rotatable combing cylinder, a reciprocating nipper jaw unit and at least one detaching roller for removing a fiber tuft from the nipper jaw unit. In accordance with the invention, at least one electric motor is provided for rotating the detaching roller with a pilgrim step motion.

The electric motor, for example, a brushless direct current motor or an asynchronous motor, can be fed from a control unit which is fed with drive pulses which are synchronized with the rotation of the comb cylinder, so that the motor, preferably over a reduction gear transmission, first rotates the detaching roller backwards and then forwards during each comber nip. It is however, possible to arrange for an individual motor for each of the backwards and forwards rotation of the detaching roller, whereby each motor is connected to the detaching roller over a coupling.

These and other objects and advantages of the invention will become more apparent from the following detailed description taken in conjunction with the accompany drawings wherein.

Figure 1:
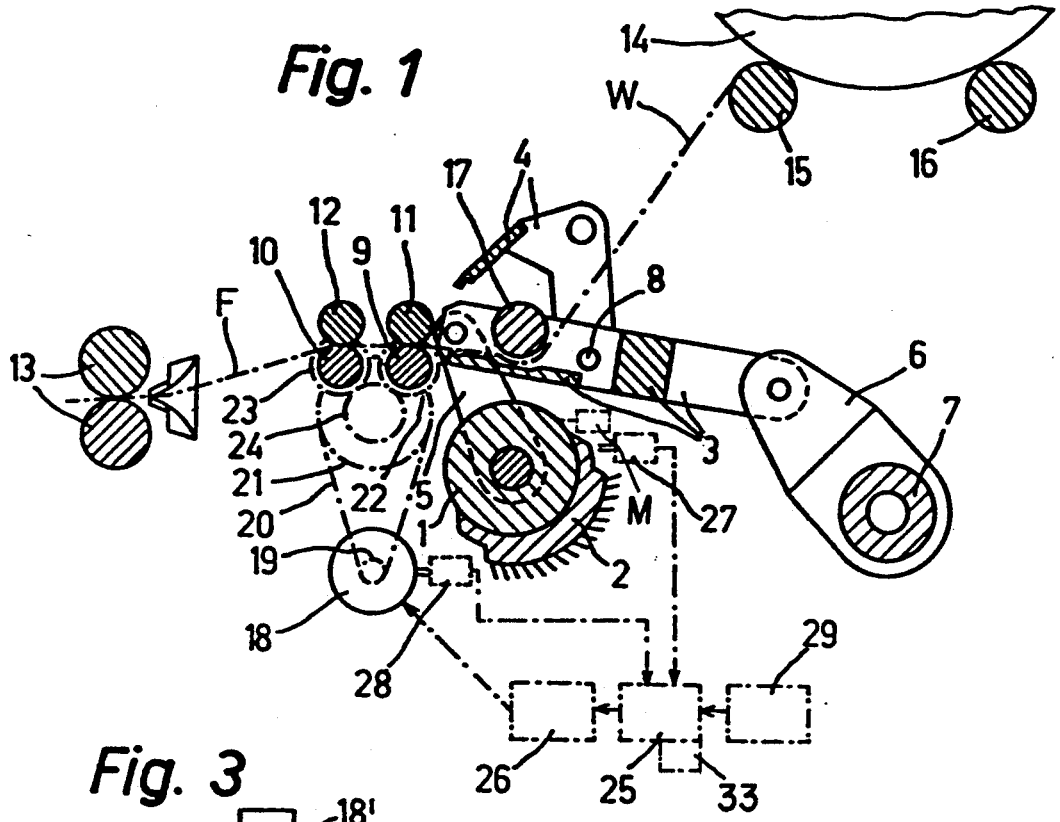
FIG. 1 illustrates a cross sectional view of a combing head for a combing machine constructed in accordance with the invention.

Referring to FIG. 1, the combing machine is provided with a plurality of combing heads, only one of which is shown for purposes of simplicity. As indicated, the combing head has a continuously rotatable comb cylinder 1 which is driven by a motor M. As indicated, the comb cylinder 1 carries a circular comb segment 2 of conventional structure.

In addition, the combing head has a reciprocating nipper jaw unit consisting of a lower nipper 3 and an upper nipper 4. The lower nipper 3 is provided at a front end on swivelling front supports 5 of an axle of the comb cylinder 1 and is pivoted at a rear end on nipper arms 6, which are fitted on a reciprocating nipper shaft 7. The upper nipper 4 can be pivoted on an axis 8 in relation to the lower nipper 3.

Further, the comber head has two detaching rollers 9, 10, on each of which one detaching top roller 11, 12 is fitted for removing fiber tuft from the nipper jaw unit as well as a pair of take off rollers 13.

A lap W to be combed is led from a lap supply roll 14, which rests on two rotatable lap rollers 15 and 16, to an intermittently rotating feed roller 17 supported in the lower nipper 3. In a retracted position (not shown) of the nipper jaw unit, this unit is closed and firmly holds an end section of the lap W protruding from the nipper jaw unit in the form of a tuft.

During operation of the nipper jaw unit 3, 4, the tuft is combed out by the circular comb segment 2 on the rotating comb cylinder 1 while the nipper jaw unit 3, 4 moves into the forward open position shown. The detaching rollers 9, 10 are meanwhile turned backwards through a determined angle, in order to permit the rear end section of the previously combed fiber sliver F to emerge from the clamping position of the detaching roller 9 with the detaching top roller 11 towards the rear (to the nip jaw unit). The tuft combed out by the circular comb segment 2 lies on this end section and is drawn, together with this, into the clamping position of the detaching roller 9, when the detaching rollers 9 and 10 are subsequently rotated forward through a second predetermined angle which is greater than the first named predetermined angle, e.g. about twice the size and they thereby detach the tuft from the lap lying in the nipper jaw unit 3, 4. Normally, the tuft is thereby drawn through a fixed comb, which is, not shown in the drawing to avoid impairing the clarity of the drawings.

The detaching rollers 9, 10 thus must be rotated backwards through a predetermined angle in every comber nip and then rotated forwards through another larger predetermined angle. This movement is known as a pilgrim step motion. To this end, at least one electric motor 18, e.g. a brushless direct current motor or an asynchronous motor, is provided for the rotation of the detaching rollers 9, 10. The motor 18 is connected with the detaching rollers 9, 10 over a reduction gear transmission. In the example shown, this transmission contains a gear wheel 19 on the shaft of the motor 18 which is coupled over a toothed belt 20 with a second gear wheel 21. There is a gear wheel 22, 23 fitted on the shaft of each of the detaching rollers 9, 10 respectively. The gear wheels 22, 23 mesh with a pinion 24 which is fitted to the shaft of the gear wheel 21.

An electronic program control unit 25 is provided to drive the motor 18. In particular, the control unit 25 is provided to drive the motor 18 in synchronism with the rotation of the comb cylinder 1.

As indicated in FIG. 1, the electric program control unit 25 emits electric drive pulses to the electric motor 18 over an amplifier 26 so that the electric motor 18 rotates the detaching rollers 9, 10 through the desired angle on every comber nip.

In order to synchronize the drive pulses with the rotation of the comb cylinder 1, a revolution counter or a position indicator 27 is positioned near the comb cylinder 1 to sense markings on an element (not shown) fitted to the shaft of the comb cylinder 1. The position indicator 27 serves to deliver a signal to the control unit 25 indicative of the rotation of the comb cylinder 1. The control unit 25 thereafter delivers a suitable drive pulse to the motor 18 based upon the indicated rotation of the comb cylinder 1.

The control unit 25 may expediently be fitted with a regulator 33 which arranges the drive pulse in such a way that the detaching rollers 9, 10 are rotated each time through the desired predetermined angle. In order to provide a control standard, a revolution counter or a position indicator 28 is located adjacent the shaft of the motor 18 so as to sense the markings of an element (not shown) fitted to the shaft of the motor 18. The position indicator 28 thus serves to deliver a corresponding signal to the control unit 25 in order to compare the actual rotation of the shaft of the motor 18 with the desired angle of rotation.

The control unit 25 and the amplifier 26 are fed from a current supply unit 29.

Figure 2:
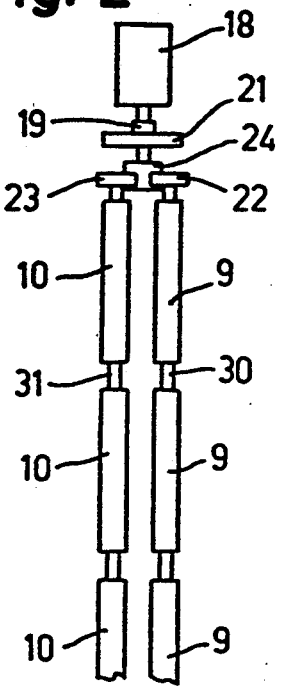
FIG. 2 illustrates a plan view of a combing machine employing a plurality of pairs of detaching rollers which are mechanically coupled together in accordance with the invention.

As a rule, a combing machine has several comber heads, of the type previously described, arranged in a row. In a combing machine of this type, the detaching rollers 9, 10 of the various comber heads—or at least some of these—can be all coupled together through a common shaft 30, 31 and collectively driven by the electric motor over a gear transmission 19, 20, 21, 22, 23, 24 as shown schematically in FIG. 2.

In a variant, it is also possible to use two separate electric motors for both directions of rotation of the detaching rollers 9, 10 instead of one reversible motor 18.

Figure 3:
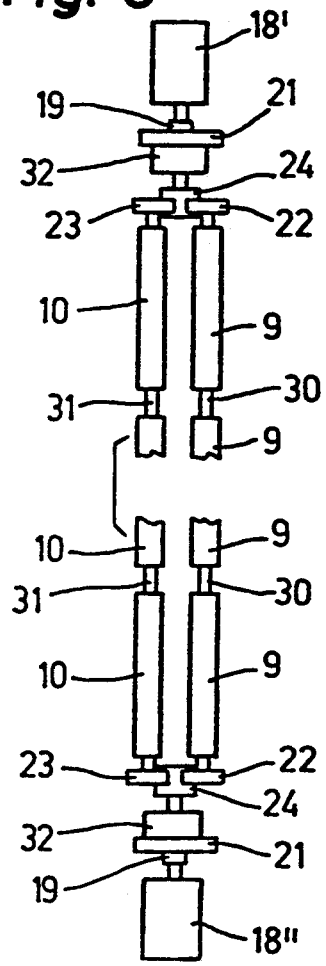
FIG. 3 illustrates a view similar to FIG. 2 having two electric motors for the driving of a plurality of pairs of detaching rollers in accordance with the invention.

Referring to FIG. 3, wherein like reference characters indicate like parts as above, and which shows a schematic partial section of the detaching rollers of the multiple comber head of a combing machine, an electric motor 18' is arranged on one end of the common shafts 30, 31 of the detaching rollers 9, 10 to rotate the detaching rollers 9, 10 backwards over a gear transmission 19, 20, 21, 22, 23, 24. In this gear transmission, a coupling 32 is additionally arranged between the gear wheels 21 and 24. A second electric motor 18" is arranged on the opposite end of the shafts 30, 31, for the forward rotation of the detaching rollers 9, 10. A coupling 32 is again arranged in the gear transmission 19, 20, 21, 22, 23 and 24 between the motor 18" and the detaching rollers 9, 10.

Figure 4:
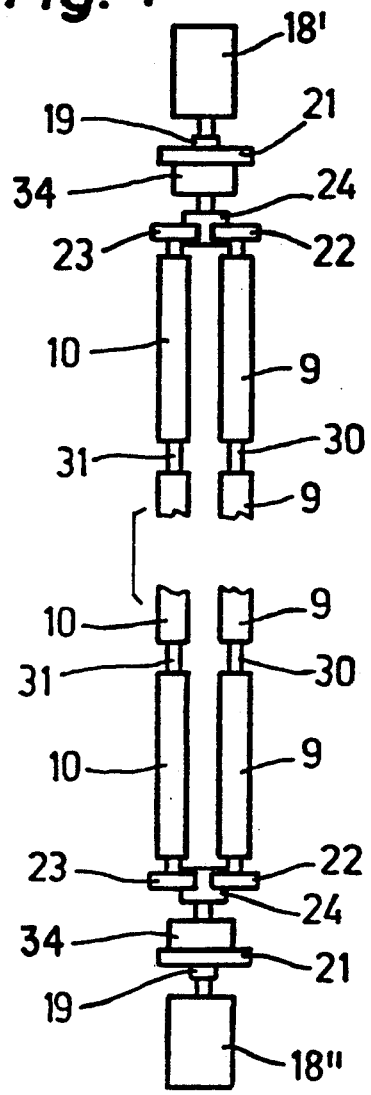
FIG. 4 illustrates a view similar to FIG. 3 of a modified arrangement for coupling the electric motors to a plurality of detaching rollers.

A control unit 25 controls the drive pulses to the electric motors 18', 18" and/or activates the couplings 32 in order to rotate the detaching rollers 9, 10 through the angle required, backwards and then forwards, during every comber nip. As shown in FIG. 4, wherein like reference characters indicate like parts as above, free wheels 34" can also be used instead of the couplings 32, in particular blockable free wheels, so that the one motor 18" is not also rotated when the other motor 18' rotates the detaching rollers 9, 10 backwards and the converse applies.

In another variant, the reversible electric motor 18 (FIGS. 1 and 2) only drives the detaching rollers 9 over the gear transmission 19, 20, 21, 22, 24, without the gear wheel 23 on the shaft 31. The detaching rollers 10 are then driven from a second reversible electric motor (not shown), which is arranged on the other end of the shafts 30, 31 and which is coupled to the shaft 31 over a gear transmission (similar to the gear transmission 19, 20, 21, 22, 23, 24). The electric motor 18 and the second electric motor (not shown) are fed with the same synchronized drive pulses from the control unit 25.

The invention thus provides a combing machine which is of relatively simple construction and which does not require reciprocation of relatively large masses.

Further, the invention provides a drive for the detaching roller of a combing head which can use a simple inexpensive reduction gear transmission

What is claimed is:

1. A combing head for a combing machine comprising a continuously rotatable comb cylinder;

a motor for driving said comb cylinder;

a reciprocating nipper jaw unit;

at least one detaching roller for removing a fiber tuft from said nipper jaw unit; and at least one electric motor for rotating said detaching roller with a pilgrim step motion.

2. A combing head as set forth in claim 1 further comprising a reduction gear coupling said electric motor to said roller.

3. A combing head as set forth in claim 1 wherein said electric motor is a brushless direct current motor.

4. A combing head as set forth in claim 1 wherein said electric motor is an asynchronous motor.

5. A combing as set forth in claim 1 further comprising a control unit for synchronizing said motor with the rotation of said electric comb cylinder.

6. A combing head as set forth in claim 5 wherein said control unit includes a regulator for producing a drive pulse to rotate said motor through a predetermined angle.

7. A combing head as set forth in claim 1 further comprising a pair of said detaching rollers, said electric motor being connected to each said roller to rotate said rollers in synchronism.

8. A combing head as set forth in claim 1 further comprising a pair of said detaching rollers and a pair of said electric motors, each said electric motor being connected to a respective one of said rollers.

9. A combing head as set forth in claim 1 wherein said electric motor is reversible in operation to rotate said roller forwards and backwards.

10. A combing machine comprising a plurality of detaching rollers for a plurality of combing heads disposed in longitudinally aligned manner;

means mechanically coupling said rollers to each other; and at least one electric motor directly connected to at least one of said rollers for rotating said rollers in unison.

11. A combing head for a combing machine comprising a rotatable combing cylinder;

means for driving said comb cylinder;

a reciprocating nipper jaw unit;

at least one detaching roller for removing a fiber tuft from said nipper jaw unit;

an electric motor for rotating said detaching roller in alternating backwards and forwards direction; and an electronic control unit connected to said motor and said comb cylinder for operating said motor in synchronism with the rotation of said comb cylinder.

12. A combing head as set forth in claim 11 wherein said control unit includes a regulator for emitting a drive pulse to said motor to rotate said roller over a predetermined angle of rotation.

13. A combing head as set forth in claim 12 further comprising a pair of said detaching rollers, said motor being connected to each said roller to rotate said rollers in synchronism.

14. A combing head as set forth in claim 11 wherein said motor is reversible in operation to rotate said roller forwards and backwards.

15. A combing head for a combing machine comprising a continuously rotatable comb cylinder;

means for driving said comb cylinder;

a reciprocating nipper jaw unit;

at least one detaching roller for removing a fiber tuft from said nipper jaw unit;

at least one electric motor for rotating said detaching roller with a pilgrim step motion; and a control unit for synchronizing said motor with the rotation of said comb cylinder, said control unit including a regulator for producing a drive pulse to rotate said motor through a predetermined angle.

16. A combing head for a combing machine comprising a continuously rotatable comb cylinder;

means for driving said comb cylinder;

a reciprocating nipper jaw unit;

at least one detaching roller for removing a fiber tuft from said nipper jaw unit;

at least one electric motor for rotating said detaching roller with a pilgrim step motion;

a first coupling between said motor and said roller for rotating said roller in one direction;

a second motor; and a second coupling between said second motor and said roller for rotating said roller in a second direction.

17. A combing head for a combing machine comprising a continuously rotatable comb cylinder;

means for driving said comb cylinder;

a reciprocating nipper jaw unit;

at least one detaching roller for removing a fiber tuft from said nipper jaw unit;

at least one electric motor for rotating said detaching roller with a pilgrim step motion;

a first free wheel between said motor and said roller for rotating said roller in only one direction;

a second motor; and a second free wheel between said second motor and said roller for rotating said roller in only a second direction.

18. A combing head as set forth in claim 17 wherein each free wheel is blockade.

* * * * *

UNITED STATES PATENT AND TRADEMARK OFFICE

CERTIFICATE OF CORRECTION

PATENT NO. : 5,022,122

DATED : June 11, 1991

INVENTOR(S) : HEINZ CLEMENT

It is certified that error appears in the above-identified patent and that said Letters Patent is hereby corrected as shown below:

Column 1, line 20 change "be" to -to be-
Column 1, line 55 change "rotation" to -rotations-
Column 1, line 60-61 change "accompany" to -accompanying-
Column 2, line 51 change "is, not" to -is not-
Column 6, line 34 change "blockade" to -blockable-

Signed and Sealed this

Eighth Day of December, 1992

*Attest:*

DOUGLAS B. COMER

*Attesting Officer*

*Acting Commissioner of Patents and Trademarks*